US006446960B1

(12) United States Patent
Okada

(10) Patent No.: US 6,446,960 B1
(45) **Date of Patent: *Sep. 10, 2002**

(54) SHEET FEEDING DEVICE

(75) Inventor: Koichi Okada, Odawara (JP)

(73) Assignee: Fuji Photo Film Co., Ltd., Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/520,128

(22) Filed: Mar. 6, 2000

(30) Foreign Application Priority Data

Mar. 4, 1999 (JP) ..... 11-057465
Mar. 4, 1999 (JP) ..... 11-057542

(51) Int. Cl.[7] ..... B65H 9/00
(52) U.S. Cl. ..... 271/240; 271/273
(58) Field of Search ..... 271/273, 274, 271/240, 171

(56) References Cited

U.S. PATENT DOCUMENTS

| | | | | |
|---|---|---|---|---|
| 4,912,484 A | * 3/1990 | Yamagishi et al. | ..... | 347/188 |
| 5,172,138 A | * 12/1992 | Okazawa et al. | ..... | 271/240 |
| 5,205,551 A | * 4/1993 | Nagano et al. | ..... | 271/273 |
| 5,215,303 A | * 6/1993 | Yamada et al. | ..... | 271/240 |
| 5,996,989 A | * 12/1999 | Cahill et al. | ..... | 271/121 |
| 6,149,150 A | * 11/2000 | Onipchenko | ..... | 271/240 |
| 6,164,642 A | * 12/2000 | Onipchenko et al. | ..... | 271/240 |
| 6,170,820 B1 | * 1/2001 | Hutson | ..... | 271/274 |

FOREIGN PATENT DOCUMENTS

| | | | | |
|---|---|---|---|---|
| EP | 0 803 764 | 10/1997 | ..... | G03C/1/498 |
| EP | 0 803 765 | 10/1997 | ..... | G03C/1/498 |
| JP | 0128147 | * 7/1984 | ..... | 271/240 |
| JP | 0258343 | * 10/1988 | ..... | 271/274 |
| JP | 0056356 | * 2/1990 | ..... | 271/273 |
| JP | 4-211252 | 8/1992 | ..... | G03F/7/004 |
| JP | 4-249251 | 9/1992 | ..... | G03F/7/004 |
| JP | 5-113629 | 5/1993 | ..... | G03C/5/08 |
| JP | 8-062803 | 3/1996 | ..... | G03C/8/26 |
| JP | 8-211521 | 8/1996 | ..... | G03C/1/00 |
| JP | 9-061978 | 3/1997 | ..... | G03C/8/40 |
| JP | 9-152705 | 6/1997 | ..... | G03C/8/12 |
| JP | 9-258404 | 10/1997 | ..... | G03C/8/40 |
| JP | 9-274295 | 10/1997 | ..... | G03C/8/40 |
| JP | 10-071740 | 3/1998 | ..... | B41J/2/44 |
| JP | 10-254111 | 9/1998 | ..... | G03C/8/40 |
| JP | 11-084610 | 3/1999 | ..... | G03C/8/40 |
| JP | 11-212230 | 8/1999 | ..... | G03C/8/40 |
| JP | 11-288070 | 10/1999 | ..... | G03C/8/40 |

OTHER PUBLICATIONS

"Thermally Processed Silver Systems." D. Klosterboer, Imaging Processes and Materials,Neblette, 8th edition, edited by Sturge, V. Wlaworth and A. Shepp, Chapter 9, pp. 270–291, 1989.
Research Disclosure Jun. 1978, 17029 (pp. 9–15).

* cited by examiner

*Primary Examiner*—H. Grant Skaggs
(74) *Attorney, Agent, or Firm*—Sughrue Mion, PLLC

(57) ABSTRACT

Roller pairs comprise respective upper rollers and respective lower rollers. The lower rollers are associated with respective displacement members connected thereto. The displacement members have oblong holes defined therein, and eccentric shafts fixed to respective ends of a rotatable shaft connected to a motor are supported in the respective oblong holes. A transversely shifting mechanism has a pair of transversely shifting fingers for transversely pressing a recording sheet toward a center thereof, and a displacing mechanism for displacing the transversely shifting fingers. The displacing mechanism comprises a pair of racks disposed on transverse shifters movable back and forth in the transverse direction of the recording sheet, an a pinion held in mesh with the racks and rotatable by a motor. The transverse shifters have integral transversely shifting fingers, respectively, for pressing the recording sheet.

20 Claims, 7 Drawing Sheets

SHEET FEEDING DEVICE

BACKGROUND OF THE INVENTION

1. Field of the Invention

The present invention relates to a sheet feeding device, and more particularly to a sheet feeding device having a nip mechanism in a roller pair for feeding a sheet and a transversely shifting mechanism for transversely shifting a sheet.

2. Description of the Related Art

Generally, a roller pair of feeding a sheet comprises a fixed roller and a nip roller movable toward and away from the fixed roller.

Some sheet feeding devices comprise two roller pairs that are successively operated into open and closed positions. The nip rollers of the respective roller pairs are individually associated with respective displacing mechanisms for displacing the nip rollers. Because of these displacing mechanisms, the sheet feeding device are poor in durability and high in cost. The individual displacing mechanisms take up a large installation space, resulting in a difficulty in effectively utilizing an available space.

Heretofore, the sheet feeding devices have a positioning mechanism for transversely positioning a sheet. The positioning mechanism comprises a positioning plate extending along the direction in which to feed the sheet and a presser for pressing the sheet against the positioning plate. The positioning plate positions one side edge of the sheet. If the positioning mechanism is used to position a sheet in an apparatus for reading or recording images, then an image can accurately be read from or recorded on the sheet at a desired position thereon.

The positioning mechanism positions the sheet with respect to one of its side edges. Therefore, if sheets of different sizes are used in the image reading or recording apparatus, then a sheet is fed in a different position depending on the size of the sheet. At this time, the pressure applied to the rollers for feeding the sheet is brought out of transverse balance, with the result that the sheet may not be kept in an accurate position in its transverse direction.

SUMMARY OF THE INVENTION

It is therefore an object of the present invention to provide a sheet feeding device which is highly durable, can be manufactured inexpensively, and has a nip mechanism that allows an available space to be utilized effectively.

Another object of the present invention is to provide a sheet feeding device which is simple in structure and has a transversely shifting mechanism capable of positioning a sheet accurately in the transverse direction thereof.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
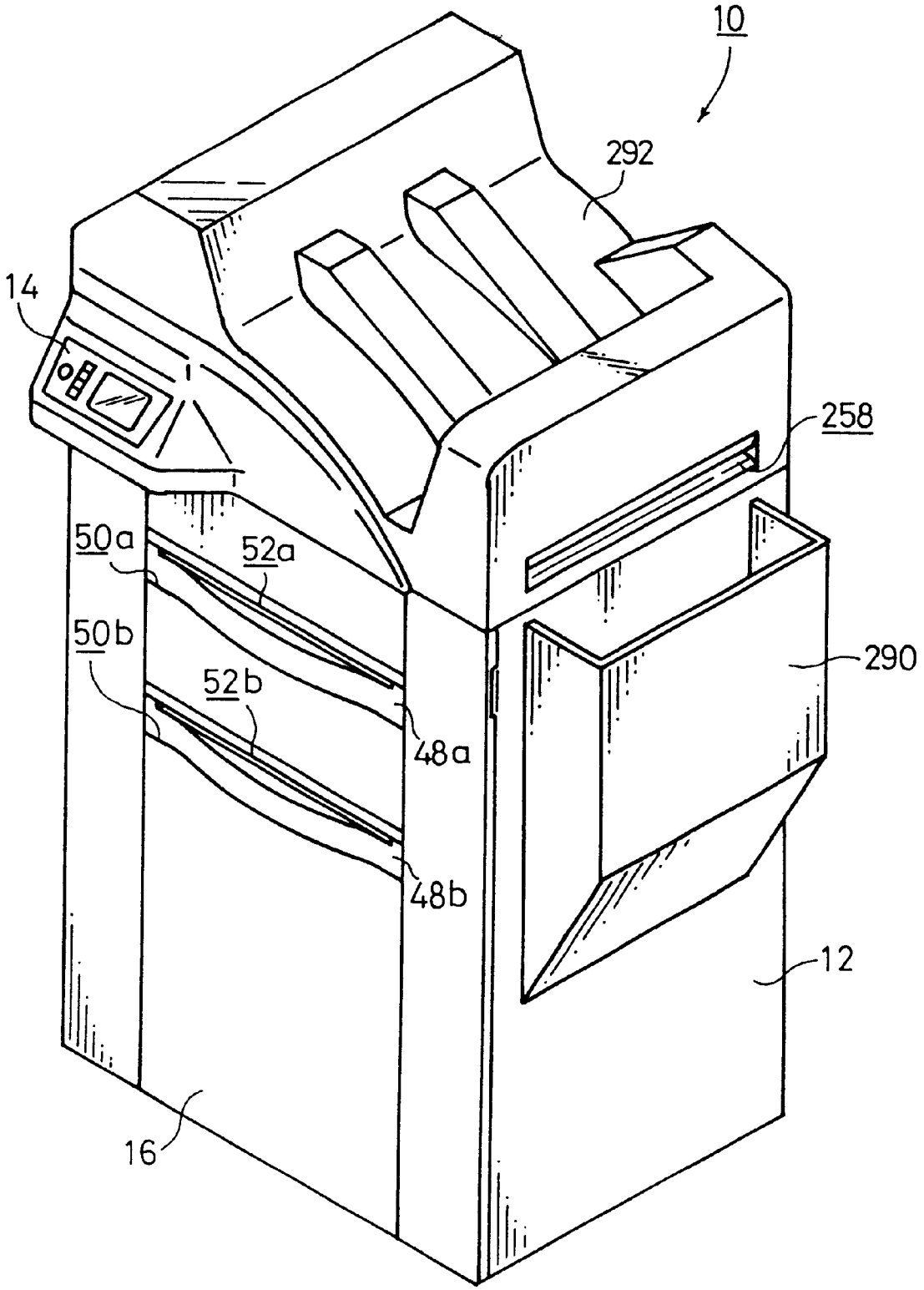
FIG. 1 is a perspective view of an image recording apparatus according to an embodiment of the present invention.

A preferred embodiment of an image recording apparatus which incorporates a sheet feeding device according to the present invention will be described in detail below with reference to the accompanying drawings.

An image recording apparatus according to the embodiment of the present invention is a dry system in which a latent image on an image recording medium is developed into a visible image on dry development principles, i.e., without using developing liquid solutions, by the application of a laser beam to the image recording medium.

The following dry development principles (1) through (4) may be employed in the image recording apparatus.

(1) A photosensitive medium on which a latent image is formed is superposed on an image receiving medium, and the photosensitive medium and the image receiving medium are heated and, if necessary, simultaneously pressed together to transfer the latent image from the photosensitive medium to the image receiving medium (see, for example, Japanese laid-open patent publications Nos. 5-113629, 8-62803, 9-152705, 9-258404, 9-61978, 10-71740, 11-288070, 10-254111, and 11-84610).

(2) A photosensitive medium on which a latent image is formed is superposed on a processing medium, and the photosensitive medium and the processing medium are heated to develop the latent image into a visible image (see, for example, Japanese laid-open patent publications Nos. 9-274295 and 11-212230).

(3) After a latent image is formed on a photosensitive medium which has a photosensitive layer comprising a silver halide acting as a photocatalyst, a silver salt acting as an image forming substance, and a silver ion reducing agent, etc., all dispersed in a binder, the photosensitive medium is heated to a certain temperature to develop the latent image into a visible image (see, for example, "Thermally Processed Silver Systems", D. Klosterboer, Imaging Processes and Materials, Neblette, 8th edition, edited by Sturge, V. Walworth, and A. Shepp, Chapter 9, Page 279, 1989, Research Disclosure 17029 (1978), EP803764A1, EP803765A1, and Japanese laid-open patent publication No. 8-211521).

(4) A photosensitive thermosensitive recording medium having a photosensitive thermosensitive recording layer comprising thermally responsive microcapsules which contain an electron-donative colorless dye, a compound having an electron acceptor and a polymerizable vinyl monomer in the same molecule, and a photopolymerization initiator is used (see, for example, Japanese laid-open patent publication No. 4-249251), or a photosensitive thermosensitive recording medium having a photosensitive thermosensitive recording layer comprising thermally responsive microcapsules which contain an electron-donative colorless dye, an electron-acceptive compound, a polymerizable vinyl monomer, and a photopolymerization initiator is used (see, for example, Japanese laid-open patent publication No. 4-211252).

In the processes (1) and (2) mentioned above, a small amount of water may be added to the photosensitive medium for accelerating the visualization of the latent image formed on the photosensitive medium.

In the description of the present embodiment, the photosensitive mediums and photosensitive thermosensitive recording mediums in the processes (1) through (4) will hereinafter be referred to collectively as a "thermal development photosensitive medium".

FIG. 1 shows in perspective an image recording apparatus 10 according to the embodiment of the present invention.

The image recording apparatus 10 has a touch panel 14 in an upper left portion of a front wall of an apparatus housing 10. The touch panel 14 serves as a control console operable by the operator for controlling the image recording apparatus 10 and a monitor for displaying information for the operator.

The front wall of the apparatus housing 12 has an openable and closable door 16 disposed below the touch panel 14. When the door 16 is opened, the operator can access a sheet supply unit 22, a pre-feeder 24, an image recorder 26, a transfer unit 28, a thermal development unit 30, and a sheet discharger 34 (described later on) disposed in the apparatus housing 12, for servicing and maintenance.

Figure 2:
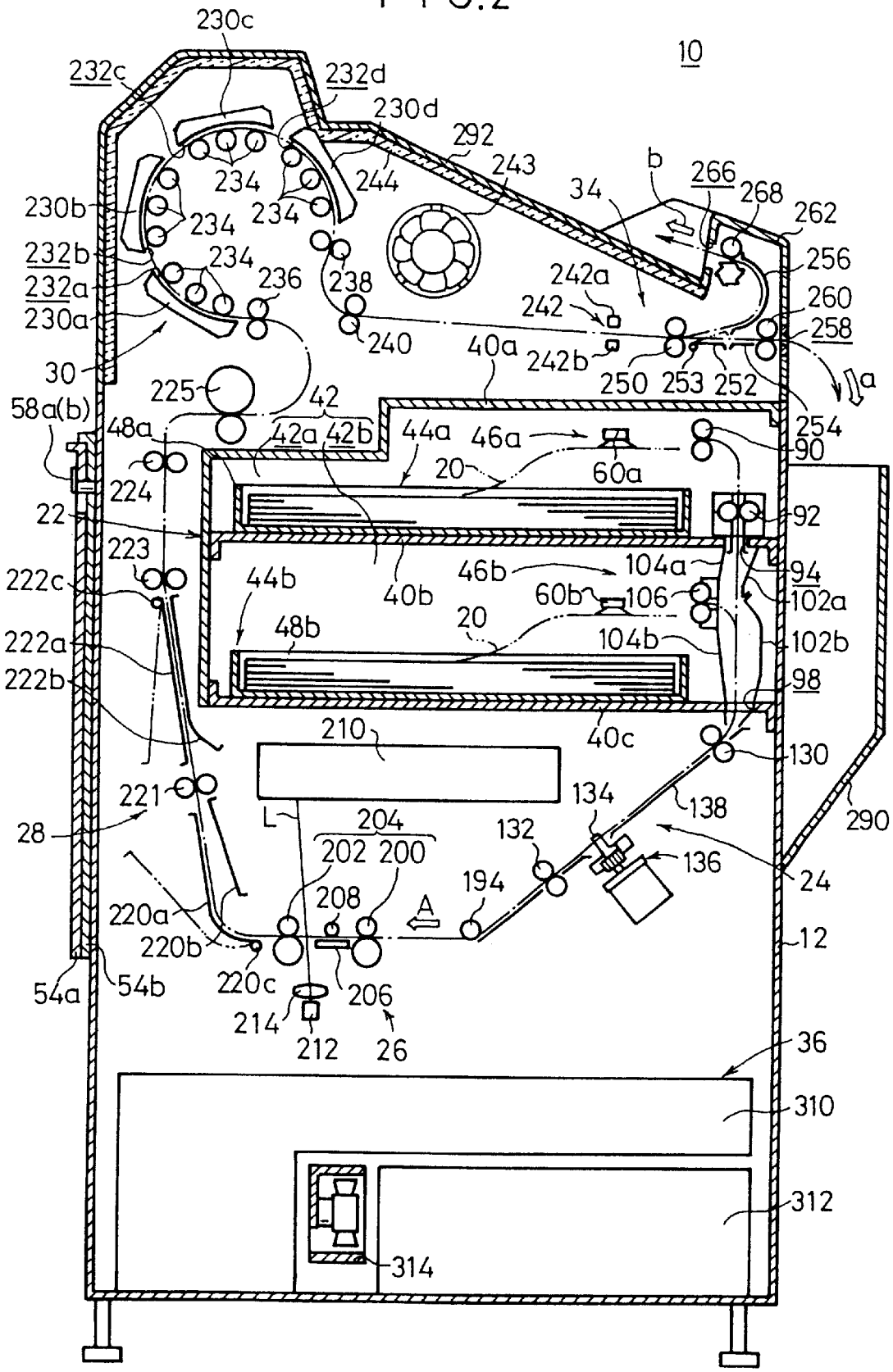
FIG. 2 is a schematic vertical cross-sectional view showing structural details of the image recording apparatus illustrated in FIG. 1.

FIG. 2 schematically shows structural details of the image recording apparatus 10. The image recording apparatus 10 serves to record an image on a recording sheet 20 as an image recording medium which comprises a thermal development photosensitive medium. The image recording apparatus 10 has the sheet supply unit 22, the pre-feeder 24, the image recorder 26, the transfer unit 28, the thermal development unit 30, and the sheet discharger 34 which are successively arranged along a feed path for the recording sheet 20. The image recording apparatus 10 also has a controller 36 for controlling operation of the sheet supply unit 22, the pre-feeder 24, the image recorder 26, the transfer unit 28, the thermal development unit 30, and the sheet discharger 34.

The apparatus housing 12 has a chamber 42 defined substantially centrally therein by light-shield plates 40*a*, 40*b*, 40*c*. The sheet supply unit 22 is disposed in the chamber 42.

The chamber 42 is vertically divided into an upper compartment 42*a* and a lower compartment 42*b* by the light-shield plate 40*b*. The upper compartment 42*a* houses therein an upper sheet loader 44*a* and an upper sheet feeder 46*a*, and the lower compartment 42*b* houses therein a lower sheet loader 44*b* and a lower sheet feeder 46*b*.

Magazines 48*a*, 48*b* are removably mounted in the upper sheet loader 44*a* and the lower sheet loader 44*b*, respectively. Each of the magazines 48*a*, 48*b* contains a plurality of recording sheets 20.

Usually, the magazines 48*a*, 48*b* contain recording sheets 20 of different sizes. For example, the magazine 48*a* contains recording sheets 20 having a size of 35.4 cm×43.0 cm or a size B4, and the magazine 48*b* contains recording sheets 20 having a size of 20.3 cm×25.4 cm.

As shown in FIG. 1, the door 16 has magazine loading/unloading slots 50*a*, 50*b* defined therein in vertically-spaced relationship. The magazines 48*a*, 48*b* can be inserted into and removed from the upper and lower sheet loaders 44*a*, 44*b* through the magazine loading/unloading slots 50*a*, 50*b*.

The magazines 48*a*, 48*b* have respective shutter insertion slots 52*a*, 52*b* defined in front faces thereof. Light-shield shutters 54*a*, 54*b* shown in FIG. 2 are hung on the outer surface of a left side wall of the apparatus housing 12. After the magazines 48*a*, 48*b* have been inserted into the upper and lower sheet loaders 44*a*, 44*b*, the operator manually inserts the light-shield shutters 54*a*, 54*b* respectively through the shutter insertion slots 52*a*, 52*b* and places them over the respective magazines 48*a*, 48*b*.

The upper sheet feeder 46*a* and the lower sheet feeder 46*b*, which are located in respective upper right portions (as viewed in FIG. 2) of the upper and lower compartments 42*a*, 42*b*, have respective suction cups 60*a*, 60*b* coupled to displacing means (not shown) which displace the suction cups 60*a*, 60*b*, respectively. The suction cups 60*a*, 60*b* can be moved into the respective magazines 48*a*, 48*b* by the displacing means.

A roller pair 90 is disposed in the upper compartment 42*a* downstream of the suction cup 60*a* with respect to the direction in which sheets 20 are fed from the magazine 48*a*. Another roller pair 92 disposed downstream of the roller pair 90. The light-shield plate 40*b* has a passage hole 94 defined therein at a position downstream of and near the roller pair 92, the passage hole 94 communicating with the lower compartment 42*b*.

The light-shield plate 40*c* has a passage hole 98 defined therein at a position below the passage hole 94, the passage hole 98 communicating with the exterior of the lower compartment 42*b*. Guide plates 102*a*, 102*b* extend vertically from a position near the right-hand edge of the passage hole 94 in the light-shield plate 40*b* to a position near the right-hand edge of the passage hole 98 in the light-shield plate 40*c*. Similarly, guide plates 104*a*, 104*b* extend vertically from a position near the left-hand edge of the passage hole 94 in the light-shield plate 40*b* to a position near the left-hand edge of the passage hole 98 in the light-shield plate 40*c*. The guide plates 102*a*, 102*b* and the guide plates 104*a*, 104*b* jointly define therebetween a space as a feed path for the recording sheets 20.

The guide plates 102*a*, 102*b* are joined directly to each other. The guide plates 104*a*, 104*b* are joined to each other by a roller pair 106 which is positioned downstream of the suction cup 60*b* of the lower sheet feeder 46*b* with respect to the direction in which sheets 20 are fed from the magazine 48*b*.

The roller pair 92 and the roller pair 106 comprise light-shield roller pairs. The roller pair 92 prevents light from entering the upper compartment 42*a* through the passage hole 94. The roller pair 106 prevents light that has entered the space between the guide plates 102*a*, 102*b* and the guide plates 104*a*, 104*b* through the passage hole 94 or the passage hole 98 from entering the lower sheet loader 44*b* in the lower compartment 42*b*.

The pre-feeder 24 is disposed downstream of the sheet supply unit 22, i.e., in a lower right portion of the apparatus housing 12 underneath the sheet supply unit 22. The pre-feeder 24 comprises a roller pair (inlet roller pair) 130 disposed near the passage hole 98, a roller pair (outlet roller pair) 132 disposed downstream of the roller pair 130, and a pair of transversely shifting fingers (pressers) 134 disposed between the roller pairs 130, 132. A displacing mechanism 136 is connected to the transversely shifting finger 134 for displacing the transversely shifting finger 134 in the transverse direction of a recording sheet 20 in the pre-feeder 24.

The pre-feeder 24 also has a plate (guide member) 138 extending along the feed path of the recording sheet 20.

Figure 3:
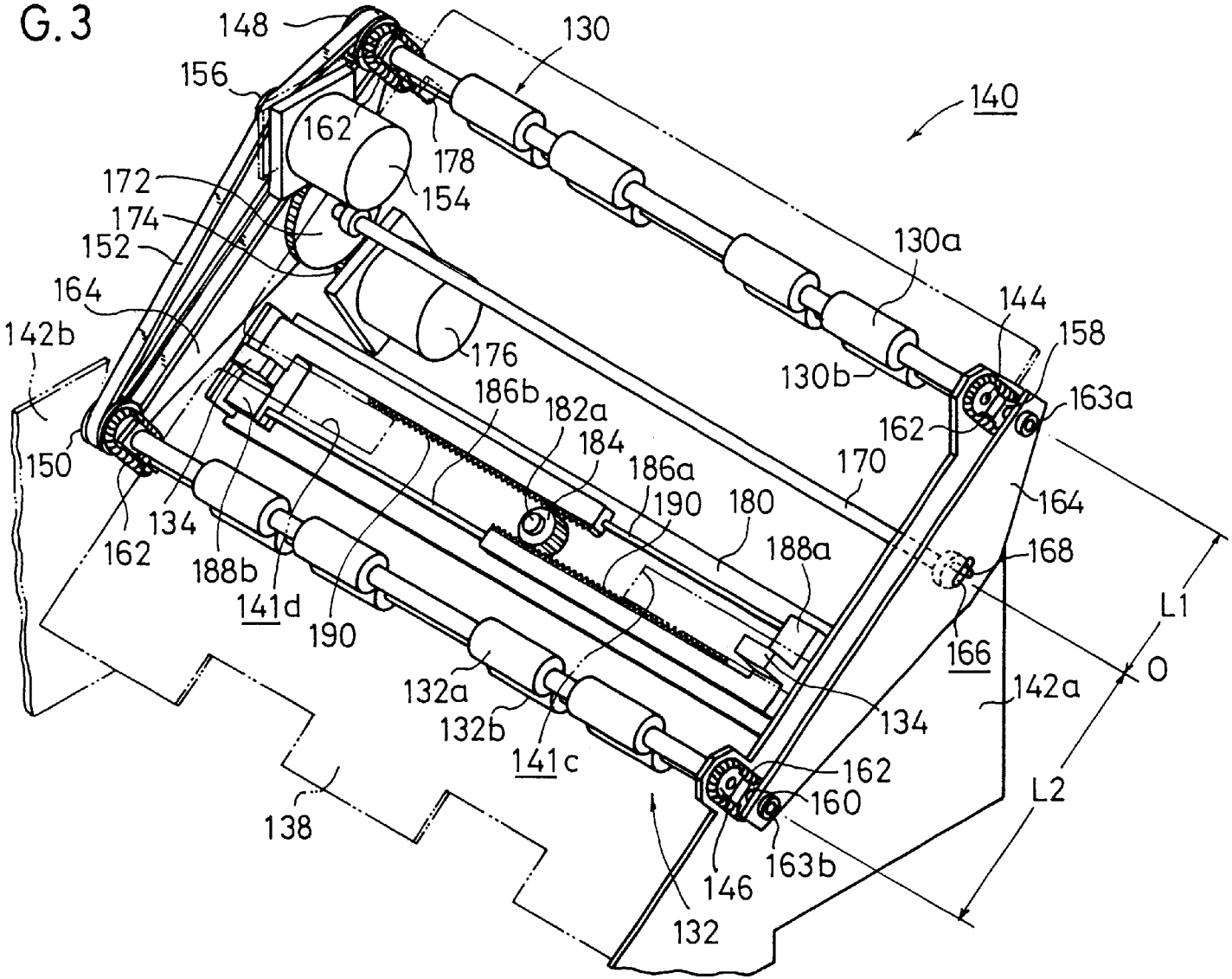
FIG. 3 is a perspective view of a transversely shifting mechanism of the image recording apparatus illustrated in FIG. 1.

As shown in FIG. 3, the roller pairs 130, 132, the transversely shifting finger 134, the displacing mechanism 136, and the plate 138 jointly make up a transversely shifting mechanism 140 for transversely positioning a recording sheet 20.

Figure 4:
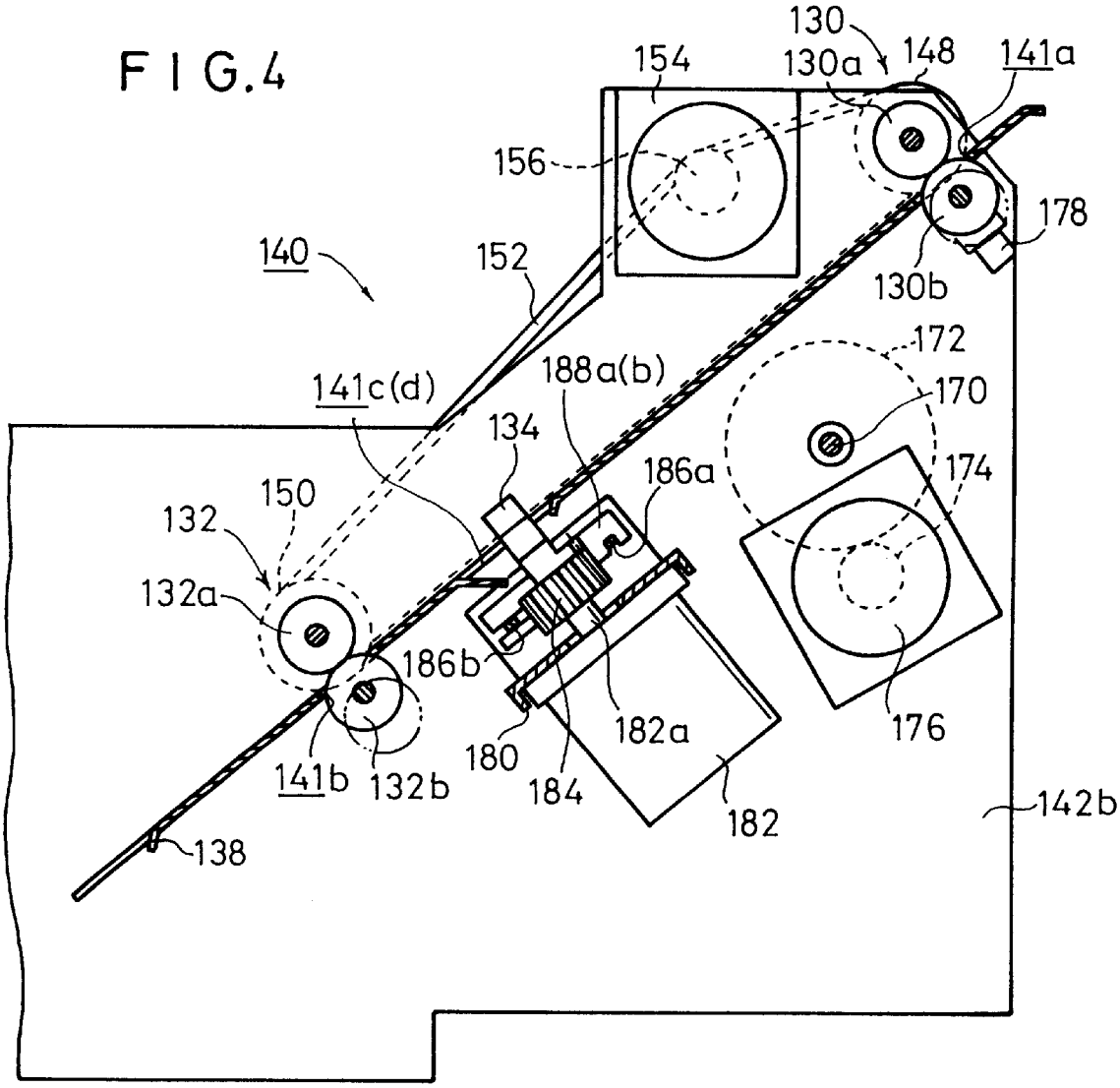
FIG. 4 is a cross-sectional view of the transversely shifting mechanism shown in FIG. 3.

The plate 138 is inclined about 20° or more to the horizontal plane such that its inlet side (right-hand side) is higher than its outlet side (left-hand side). As shown in FIG. 4, the roller pairs 130, 132 are disposed along respective holes 141*a*, 141*b* defined in the plate 138. The roller pairs 130, 132 are spaced from each other by a distance greater than the length of a recording sheet 20.

The plate 138 has grooves (not shown) defined therein such that the area of contact between the plate 138 and a recording sheet 20 thereon is about 80% or less of the surface area of the recording sheet 20. The grooves defined in the plate 138 serve to prevent the recording sheet 20 from sticking to the plate 138 due to electrostatic charges and also to reduce frictional forces produced between the recording sheet 20 and the plate 138.

As shown in FIG. 3, the transversely shifting mechanism 140 has a pair of transversely spaced support plates 142*a*, 142*b* extending vertically parallel to each other. The support plates 142*a*, 142*b* support bearings 144 and bearings 146 thereon. The roller pair 130 has an upper roller (first roller, fixed) 130*a* rotatably supported by the bearings 144, and the roller pair 132 has an upper roller (second roller) 132*a* rotatably supported by the bearings 146.

Pulleys 148, 150 are mounted on ends of the rollers 130*a*, 132*a*, and operatively coupled by a belt 152 trained therearound to a pulley 156 which is attached to the rotatable shaft (not shown) of a motor 154 (see also FIG. 4).

The roller 130*a* is combined with a one-way clutch (not shown) which prevents the roller 130*a* from being reversed.

As shown in FIG. 3, the support plates 142*a*, 142*b* support bearings 158 and bearings 160 thereon. The roller pair 130 has a lower roller (first nip roller, movable) 130*b* rotatably supported by the bearings 158, and the roller pair 132 has a lower roller (second nip roller) 132*b* rotatably supported by the bearings 160.

The bearings 158 and the bearings 160 are movable toward and away from the bearings 144 and the bearings 146, respectively. Therefore, the rollers 130*b*, 132*b* are movable toward and away from the rollers 130*a*, 132*a*, respectively. The bearings 144 and the bearings 158 are operatively coupled to each other by springs 162, and the bearings 146 and the bearings 160 are operatively coupled to each other by springs 162.

The roller 130*a* is made of a material having a small coefficient of friction, such as POM (polyacetal) or the like, and the roller 130*b* is made of a material having a large coefficient of friction, such as rubber or the like. The roller 132*a* is made of a material having a large coefficient of friction, such as rubber or the like, and the roller 132*b* is made of a material having a small coefficient of friction, such as POM.

Since the roller 130*a* is made of a material having a small coefficient of friction, frictional forces produced between a recording sheet 20 and the roller 130*a* are reduced when the recording sheet 20 is transversely shifted. Furthermore, because the roller 132*b* is made of a material having a small coefficient of friction, a recording sheet 20 is prevented from being fed back upstream when the roller pair 132 is reversed. Accordingly, a recording sheet 20 can accurately be transversely shifted.

Plate-shaped displacement members (cam members) 164 are coupled to the rollers 130*b*, 132*b* by bearings 163*a*, 163*b*. The displacement members 164 extend parallel to the support plates 142*a*, 142*b*.

The displacement members 164 have oblong holes (bearing means) 166 defined therein, and eccentric shafts 168 fixed to respective ends of a rotatable shaft 170 which is rotatably supported by the support plates 142*a*, 142*b*. The rotatable shaft 170 is operatively coupled to the rotatable shaft (not shown) of a motor 176 through pinion gears 172, 174.

The oblong holes 166 are positioned more closely to the bearings 163*a* than to the bearings 163*b*. Specifically, if it is assumed that a line interconnecting the bearings 163*a*, 163*b* intersects with a line normal to the center of the oblong hole 166 at a reference point O, then the distance L1 between the reference point O and the bearing 163*a* is about half the distance L2 between the reference point O and the bearing 163*b*.

The nip pressure applied by the inlet roller pair 130 of the transversely shifting mechanism 140 is smaller than the nip pressure applied by the outlet roller pair 132. This nip pressure setting can be achieved by changing the coefficients of elasticity of the springs 162.

Figure 5:
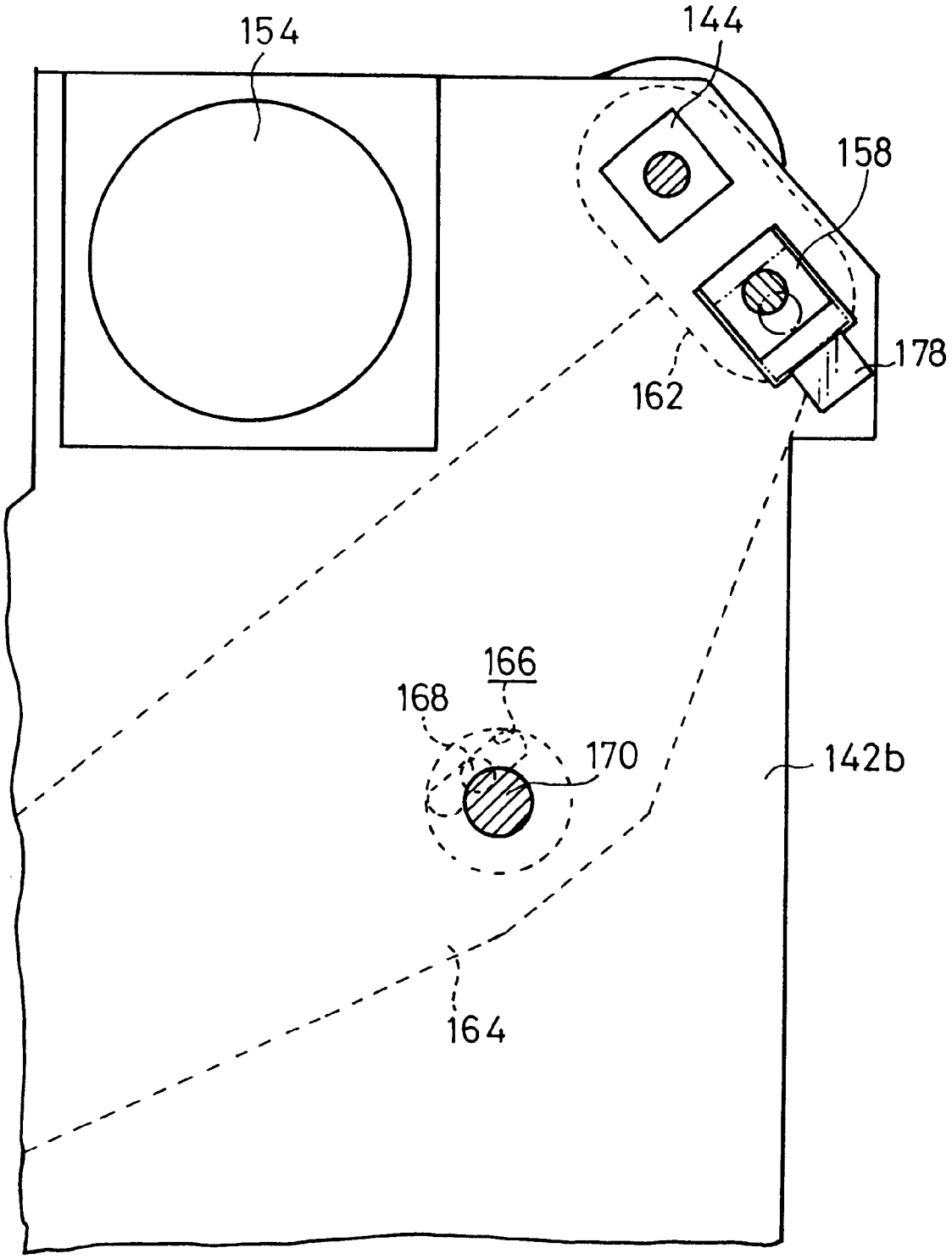
FIG. 5 is an enlarged fragmentary cross-sectional view of the transversely shifting mechanism shown in FIG. 3.

As shown in FIGS. 4 and 5, stoppers 178 are fixed to the support plates 142*a*, 142*b*. The stoppers 178 can contact the bearings 158 which support the roller 130*b* to prevent the roller 130*b* from being spaced from the roller 130*a* beyond a predetermined distance.

Figure 6:
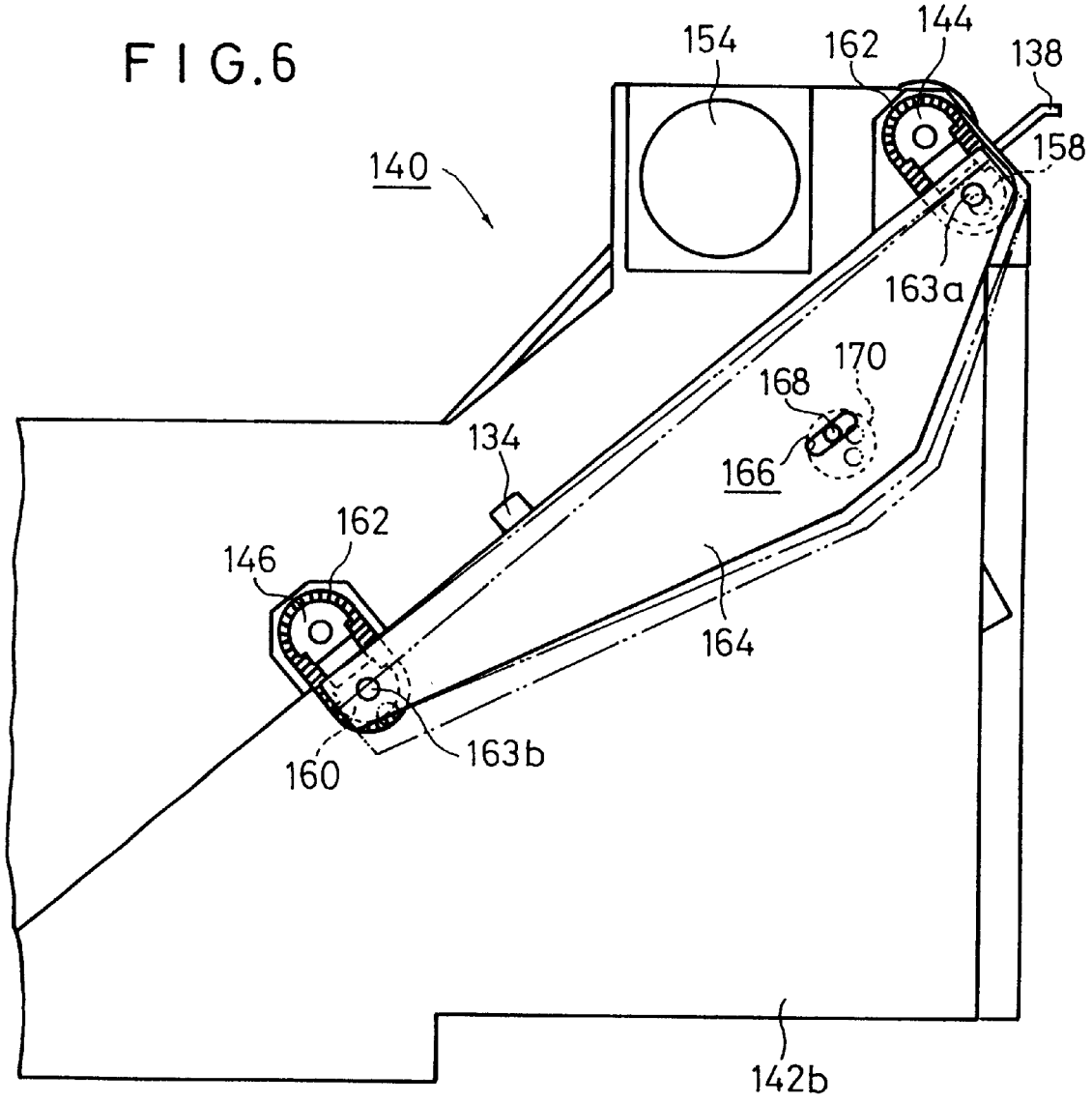
FIG. 6 is a side elevational view of the transversely shifting mechanism shown in FIG. 3.

As shown in FIGS. 3 and 6, when the motor 176 is energized to rotate the shaft 170 clockwise in FIG. 6, the eccentric shafts 168 move to the right in FIG. 6 within the oblong holes 166, angularly moving the displacement members 164 clockwise in FIG. 6 about the bearings 163*b*. At this time, the roller 130*b* is displaced away from the roller 130*a* against the resiliency of the springs 162.

Upon continued rotation of the shaft 170, the bearings 158 are brought into contact with the stoppers 178, preventing the roller 130*b* from being further displaced (see FIG. 5). When the shaft 170 is further rotated, the displacement members 164 are angularly moved counterclockwise in FIG. 6 about the bearings 163*a*, displacing the roller 132*b* away from the roller 132*a*.

Therefore, the transversely shifting mechanism 140 functions as a nip mechanism for successively moving the rollers 130*b*, 132*b* toward/away from the rollers 130*a*, 132*a*, respectively, and successively nipping a recording sheet 20 that is fed by the rollers 130*a*, 132*a*.

As shown in FIGS. 3 and 4, a motor (actuator) 182 is fixedly mounted on a base 180 extending between and fixed to the support plates 142*a*, 142*b*. The motor 182 has a rotatable shaft 182*a* with a pinion 184 mounted thereon.

Two rails 186*a*, 186*b* are attached to and extend between the support plates 142*a*, 142*b* parallel to the base 180. Two L-shaped transverse shifters 188*a*, 188*b* are movably supported respectively on the rails 186*a*, 186*b*.

The transverse shifters 188*a*, 188*b* have respective racks 190 integrally disposed on their portions extending parallel to the rails 186*a*, 186*b*, the racks 190 being held in mesh with the pinion 184. The transverse shifters 188*a*, 188*b* have the transversely shifting fingers 134 integrally disposed respectively on their portions extending perpendicularly to the rails 186*a*, 186*b*. The transversely shifting fingers 134 project through respective recesses 141*c*, 141*d* defined in the plate 138 upwardly beyond an upper surface of the plate 138.

The motor 182, the pinion 184, the racks 190, etc. jointly make up the displacing mechanism 136 for displacing the transversely shifting fingers 134. The transversely shifting fingers 134 and the displacing mechanism 136 may also be referred to as a pressing means for pressing a sheet.

Each of the transversely shifting fingers 134 has an inner surface (pressing surface) which is recessed in a triangular cross section for reliably transversely shifting a recording sheet 20.

While the displacing mechanism 136 includes the pinion 184 and the racks 190 in the illustrated embodiment, the displacing mechanism 136 may instead include a timing belt, a solenoid, etc.

As shown in FIG. 2, a correction roller 194 for correcting the direction in which to feed a recording sheet 20 is disposed downstream of and closely to the roller pair 132.

The image recorder 26 for forming a latent image on a recording sheet 20 is disposed downstream of the pre-feeder 24, i.e., in a lower left portion of the apparatus housing 12. The image recorder 26 has a first roller pair 200 and a second roller pair 202 which are rotatable in synchronism with each other. The first roller pair 200 and the second roller pair 202 can be opened and closed, i.e., they each have rollers that can move toward and away from each other. The first roller pair 200 and the second roller pair 202 jointly make up an auxiliary scanning mechanism 204 for feeding a recording sheet in an auxiliary scanning direction indicated by the arrow A in FIG. 2.

Between the first and second roller pairs 200, 202, there are disposed a guide plate 206 and a presser roller 208 for pressing a recording sheet 20 against the guide plate 206. The presser roller 208 is freely vertically displaceable such that it can press a recording sheet 20 under its own weight. The presser roller 208 is effective to prevent a recording sheet 20 from sagging.

An optical system 210 is disposed above the auxiliary scanning mechanism 204 for applying a laser beam L to a recording sheet 20 in a main scanning direction (which is substantially perpendicular to the auxiliary scanning direction) while the recording sheet 20 is being fed in the auxiliary scanning direction. The optical system 210 emits the laser beam L between the second roller pair 202 and the presser roller 208.

The optical system 210 has a laser beam source comprising two semiconductor lasers each having a wavelength of 660 nm and an output power of 30 mW. Laser beams emitted from the semiconductor lasers are combined into a single laser beam, which is deflected by a rotating polygonal mirror, and then applied as the laser beam L by an fθ lens to scan the recording medium 20. The laser beam L has a beam diameter of 100 $\mu$m, and is shifted a pitch of 25 $\mu$m in the auxiliary scanning direction.

The laser beam L scans a recording sheet 20 four times based on the same image information. Specifically, each time the laser beam L is shifted 25 $\mu$m in the auxiliary scanning direction, the laser beam L scans the recording sheet 20 four times in the main scanning direction to form an image (latent image) as wide as one pixel on the recording sheet 20.

A sensor 212 for detecting the leading end of a recording sheet 20 is disposed behind the recording sheet 20 remotely from the optical system 210. A lens 214 is disposed above the sensor 212 along the path of the laser beam L for correcting a positional displacement of the path of the laser beam L.

The-transfer unit 28 is disposed downstream of the image recorder 26, i.e., in a left portion of the apparatus housing 12. The transfer unit 28 has two guide plates 220*a*, 220*b* disposed downstream of and closely to the second roller pair 202 of the image recorder 26. The outer one of the guide plates 220*a* is angularly movable between open and closed positions about a rotatable shaft 220*c*. Therefore, even when a recording sheet 20 is jammed between the guide plates 220*a*, 220*b*, the recording sheet 20 can easily be removed by moving the outer guide plate 220*a* to the open position.

A roller pair 221 is disposed downstream of the guide plates 220*a*, 220*b*, and two guide plates 222*a*, 222*b* are disposed downstream of the roller pair 221. The outer one of the guide plates 222*a* is angularly movable between open and closed positions about a rotatable shaft 222*c*. Therefore, even when a recording sheet 20 is jammed between the guide plates 222*a*, 222*b*, the recording sheet 20 can easily be removed by moving the outer guide plate 222*a* to the open position.

Two roller pairs 223, 224 are disposed downstream of the guide plates 222*a*, 222*b*. The roller pairs 223, 224 have rotatable shafts (not shown) combined with one-way clutches (not shown) for limiting rotation of the roller pairs 223, 224. A cleaning roller 225 is disposed downstream of the roller pair 224.

The thermal development unit 30 for visualizing (thermally developing) a latent image formed on a recording sheet 20 is disposed downstream of the transfer unit 28, i.e., in an upper left portion of the apparatus housing 12. The thermal development unit 30 has four plate heaters 230*a* through 230*d* disposed in one circular pattern. The plate heaters 230*a* through 230*d* have respective inner surfaces 232*a* through 232*d* each having a substantially arcuate cross section. The inner surfaces 232*a* through 232*d* jointly make up a circular feed path for a recording sheet 20.

Three presser rollers 234 are held in rolling contact with each of the inner surfaces 232*a* through 232*d* of the plate heaters 230*a* through 230*d*. A roller pair 236 is disposed upstream of and closely to the plate heater 230*a*, and a roller pair 238 is disposed downstream of and closely to the plate heater 230*d*. A roller pair 240 is disposed downstream of the roller pair 238.

A sensor unit 242 for measuring the density of an image recorded on a recording sheet 20 is disposed downstream of and spaced a predetermined distance from the roller pair 240. The sensor unit 242 comprises a light-emitting element 242*a* and a light-detecting element 242*b*. The sensor unit 242 is coupled to a displacing mechanism (not shown), which can displace the sensor unit 242 along the feed path of a recording sheet 20. By adjusting the position of the sensor unit 242 with the displacing mechanism, it is possible for the sensor unit 242 to measure the density of an image recorded on a recording sheet 20 after the recording sheet 20 is sufficiently cooled.

The thermal development unit 30 has a fan 243 for discharging air out of the apparatus housing 12. However, no fan is disposed in the sheet supply unit 22, the pre-feeder 24, the image recorder 26, and the transfer unit 28. Therefore, no dust particles are produced in the sheet supply unit 22, the pre-feeder 24, the image recorder 26, and the transfer unit 28. 24, the image recorder 26, and the transfer unit 28. Therefore, no dust particles are produced in the sheet supply unit 22, the pre-heater 24, the image recorder 26, and the transfer unit 28.

A heat insulating pad 244 is attached to an inner wall surface of the apparatus housing 12 in surrounding relation to the thermal development unit 30. The heat insulating pad 244 serves to prevent heat from the plate heaters 230*a* through 230*d* from being transmitted to recording sheets 20 that have been discharged onto a second discharge tray 292 (described later on).

The sheet discharger 34 is disposed downstream of the thermal development unit 30, i.e., in an upper right portion of the apparatus housing 12.

The sheet discharger 34 has a roller pair 250 and a movable guide plate 252 disposed downstream of the roller pair 250 for switching between different feed paths. The movable guide plate 252 is coupled to an actuator (not shown) such as a solenoid or the like, and is angularly movable about a rotatable shaft 253 within a certain angular range by the actuator.

Downstream of the movable guide plate 252, there are disposed a first guide plate 254 which defines a feed path (lower feed path), and a second guide plate 256 which defines another feed path (upper feed path).

The apparatus housing 12 has a right side wall having a first discharge slot 258 defined therein downstream of the first guide plate 254. A roller pair 260 is disposed near the first discharge slot 258 immediately upstream thereof. A direction in which a recording sheet 20 is discharged from the roller pair 260 via the first discharge slot 258 to a first discharge tray 290 (described later on) will hereinafter be referred to as a first discharge direction "a".

The second guide plate 256 is of a curved shape and has a downstream end positioned in an upward bulge 262 in an upper right corner of the apparatus housing 12. The upward bulge 262 has a second discharge slot 266 defined in a left side wall thereof downstream of the second guide plate 256. A roller pair 268 is disposed near the second discharge slot 266. A direction in which a recording sheet 20 is discharged from the roller pair 268 via the second discharge slot 266 to the second discharge tray 292 will hereinafter be referred to as a second discharge direction "b".

As shown in FIGS. 1 and 2, the first discharge tray 290 is mounted on the right side wall of the apparatus housing 12 below the first discharge slot 258. The first discharge tray 290 serves to receive recording sheets 20 discharged from the first discharge slot 258. As shown in FIG. 2, the second discharge tray 292 is integrally formed with the apparatus housing 12 on its upper surface downstream of the second discharge slot 266.

The controller 36 is disposed in the apparatus housing 12 on the bottom panel thereof. The controller 36 comprises a control unit 310 and a power supply 312. The controller 36 also has a cooling fan 314 for applying cooling air to the power supply 312.

The image recording apparatus 10 according to the present invention is basically constructed as described above. Operation and advantages of the image recording apparatus 10 will be described below.

The magazines 48*a*, 48*b* each containing a stack of recording sheets 20 are placed respectively in the upper sheet loader 44*a* and the lower sheet loader 44*b* (see FIG. 2). Based on a command entered via the touch panel 14 by the operator, a recording sheet 20 is taken from either one of the magazines 48*a*, 48*b*.

A recording sheet 20 is taken from the magazine 48*a* as follows: The displacing means (not shown) coupled to the suction cup 60*a* is actuated to move the suction cup 60*a* into the magazine 48*a* and attract a recording sheet 20 therein. The displacing means is further actuated to supply the recording sheet 20 attracted by the suction cup 60*a* to the roller pair 90. The roller pair 90 feeds the recording sheet 20 to the roller pair 92, which feeds the recording sheet 20 downwardly via the passage hole 94 to a position between the guide plates 102*a*, 102*b* and the guide plates 104*a*, 104*b* in the lower compartment 42*b*.

A recording sheet 20 is taken from the magazine 48*b* as follows: The displacing means (not shown) coupled to the suction cup 60*b* is actuated to move the suction cup 60*b* into the magazine 48*b* and attract a recording sheet 20 therein. The displacing means is further actuated to supply the recording sheet 20 attracted by the suction cup 60*b* to the roller pair 106. The roller pair 106 feeds the recording sheet 20 downwardly between the guide plates 102*a*, 102*b* and the guide plates 104*a*, 104*b*.

The recording sheet 20, from either the magazine 48*a* or the magazine 48*b*, is fed between the guide plates 102*a*, 102*b* and the guide plates 104*a*, 104*b*, and supplied via the passage hole 98 to the roller pair 130 of the pre-feeder 24.

Figure 7A:
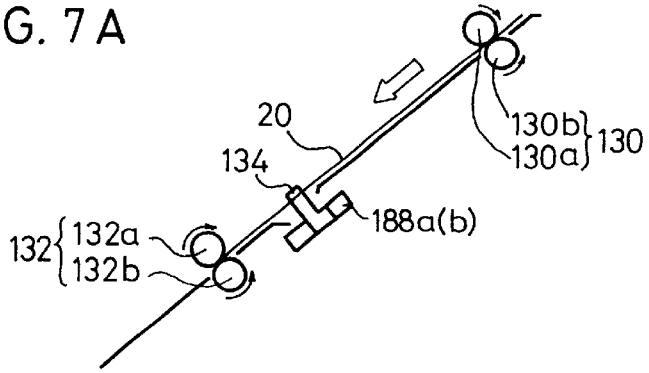
FIGS. 7A through 7D are side elevational views showing a sequence of operations of the transversely shifting mechanism shown in FIG. 3.

As shown in FIG. 7A, at the time the recording sheet 20 is supplied to the roller pair 130, the roller pair 130 and the roller pair 132 are in a closed position. At this time, the roller pair 130 and the roller pair 132 are rotated in a normal direction to feed the recording sheet 20 downstream by the motor 154 (see FIG. 3). The rotation of the roller pair 130 feeds the recording sheet 20 along the plate 138 to the roller pair 132.

Figure 7B:
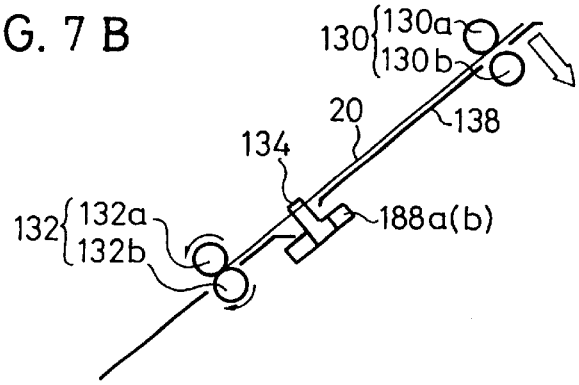

As shown in FIG. 7B, when the recording sheet 20 is supplied to the roller pair 132, the displacement members 164 are angularly moved clockwise in FIG. 6 about the bearings 163*b*, thus opening the roller pair 130 (see FIGS. 3 and 6). Specifically, the roller 130*b* supported on an end of the displacement members 164 is displaced away from the roller 130*a*. The motor 154 is operated to reverse the roller pair 132 in a direction to feed the recording sheet 20 upstream.

At this time, the motor 182 is energized to rotate the pinion 184 counterclockwise in FIG. 3, causing the racks 190 meshing with the pinion 184 to displace the transverse shifters 188*a*, 188*b* toward each other along the rails 186*a*, 186*b*. The transversely shifting fingers 134 of the transverse shifters 188*a*, 188*b* transversely shift the recording sheet 20 on the plate 138 to the center of the sheet 20. The inner surfaces of the transversely shifting fingers 134 are positioned transversely within a range of ±1 mm from a desired position of the side edges of the recording sheet 20.

After the recording sheet 20 is transversely shifted, the motor 182 rotates the pinion 184 clockwise in FIG. 3 to displace the transverse shifters 188*a*, 188*b* away from each other.

Figure 7C:
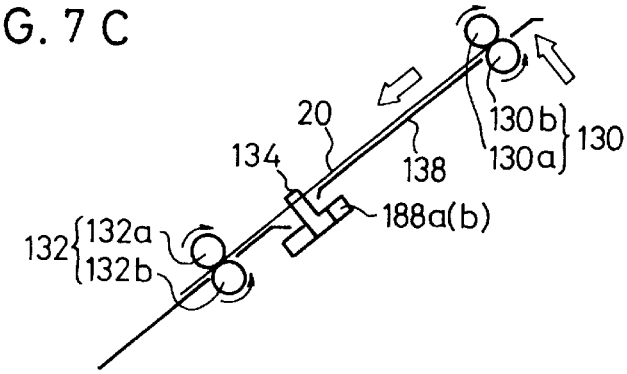

Then, as shown in FIG. 7C, the motor 176 is operated to turn the displacement members 164 counterclockwise in FIG. 6 about the bearings 163*b* for thereby closing the roller pair 130 (see FIGS. 3 and 6). Specifically, the roller 130*b* supported on the end of the displacement members 164 is displaced into contact with the roller 130*a*. The motor 154 is operated to rotate the roller pair 132 in the normal direction to feed the recording sheet 20 downstream.

Figure 7D:
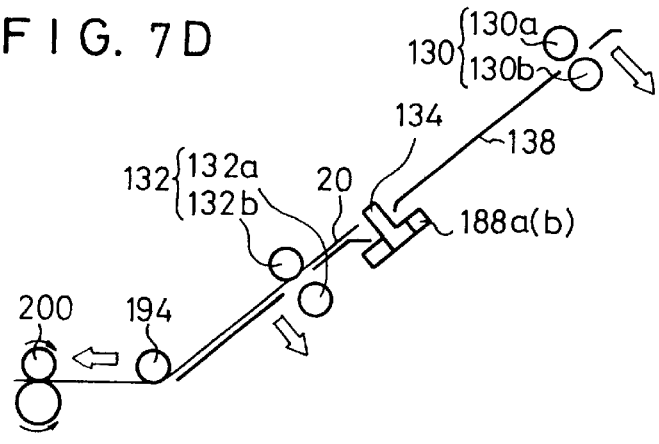

As shown in FIG. 7D, the recording sheet 20 is supplied via the correction roller 194 to the first roller pair 200 of the auxiliary scanning mechanism 204. At this time, the displacement members 164 are angularly moved clockwise in FIG. 6 about the bearings 163*b*, thus opening the roller pair 130 (see FIGS. 3 and 6). Specifically, the roller 130*b* supported on the end of the displacement members 164 is displaced away from the roller 130*a*.

When the bearings 158 are brought into contact with the stoppers 178, the displacement members 164 are angularly moved counterclockwise in FIG. 6 about the bearings 163*a*, opening the roller pair 132. That is, the roller 132*b* supported on an opposite end of the displacement members 164 is displaced away from the roller 132*a*.

When the recording sheet 20 passes across the correction roller 194 disposed downstream of the roller pair 132, the recording sheet 20 is corrected to be fed in a certain direction depending on the angle of tilt of the correction roller 194.

As shown in FIG. 2, the recording sheet 20 supplied to the first roller pair 200 is further supplied to the roller pair 202. The recording sheet 20 is fed in the auxiliary scanning direction indicated by the arrow A in FIG. 2 by the first and second roller pairs 200, 202 that are rotated in synchronism with each other. At this time, the recording sheet 20 is pressed against the guide plate 206 by the presser roller 208.

While the recording sheet 20 is being fed in the auxiliary scanning direction by the first and second roller pairs 200, 202, the laser beam L emitted from the optical system 210 is applied to the recording sheet 20 in the main scanning direction, forming a latent image on the recording medium 20. At this time, the leading end of the recording sheet 20 is confirmed by the sensor 212 which detects the laser beam L from the optical system 210 through the lens 214.

The recording sheet 20 on which the latent image has been formed by the image recorder 26 is fed by the second roller pair 202. The recording sheet 20 is then fed through the guide plates 220*a*, 220*b* of the transfer unit 28 to the roller pair 221. The recording sheet 20 is further fed by the roller pair 221, and supplied through the guide plates 222*a*, 222*b* to the two roller pairs 223, 224.

The rotation of the roller pairs 223, 224 is limited by the one-way clutches (not shown) combined with the rotatable shafts thereof.

The recording sheet 20 that has passed through the roller pairs 223, 224 is fed to the cleaning roller 225, which removes dust particles from the recording sheet 20. The recording sheet 20 is then fed to the thermal development unit 30.

In the thermal development unit 30, the recording sheet 20 is fed successively to the plate heaters 230*a* through 230*d* by the roller pair 236. At this time, the recording sheet 20 is pressed against the plate heaters 230*a* through 230*d* by the presser rollers 234, and the latent image on the recording sheet 20 is developed into a visible image by the heat from the plate heaters 230*a* through 230*d*. After the latent image has been developed into the visible image, the recording sheet 20 is fed downstream by the roller pairs 238, 240.

The speed at which the recording sheet 20 is fed by the presser rollers 234 is adjusted so as to be lower than the speed at which the recording sheet 20 is fed by the roller pairs 223, 224. This speed difference is effective to prevent the recording sheet 20 from being pushed in between the plate heaters 230*a* through 230*d* and the presser roller 234. The one-way clutches associated with the roller pairs 223, 224 allow the recording sheet 20 to be transferred smoothly from the roller pairs 223, 224 to the thermal development unit 30.

The light-emitting element 242*a* and the light-detecting element 242*b* of the sensor unit 242 disposed downstream of the roller pair 240 measure the density of the image recorded on the recording sheet 20. The recording sheet 20 that has left the sensor unit 242 is fed to the sheet discharger 34.

The recording sheet 20 are supplied to the roller pair 250 of the sheet discharger 34, and then fed thereby. One of the feed paths for the recording sheet 20 is selected by the movable guide plate 252 disposed downstream of the roller pair 250. When the movable guide plate 252 is shifted downwardly, the recording sheet 20 is fed to the lower feed path along the first guide plate 254. When the movable guide plate 252 is shifted upwardly, the recording sheet 20 is fed to the upper feed path along the second guide plate 256.

The recording sheet 20 as fed to the lower feed path is supplied along the first guide plate 254 to the roller pair 260, and then fed by the roller pair 260 to the first discharge slot 258. The recording sheet 20 is then discharged from the first discharge slot 258 along the first discharge direction "a", and placed in the first discharge tray 290 disposed below the first discharge slot 258.

The recording sheet 20 as fed to the upper feed path is supplied along the second guide plate 256 to the roller pair 268, and then fed by the roller pair 268 to the second discharge slot 266. The recording sheet 20 is then discharged from the second discharge slot 266 along the second discharge direction "b", and placed on the second discharge tray 292.

In the illustrated embodiment, as described above, the transversely shifting mechanism 140 has both a function to open and close the roller pair 130 and a function to open and close the roller pair 132. Specifically, the roller pairs 130, 132 are successively opened and closed when the eccentric shafts 168 supported in the respective oblong holes 166 are rotated to rotate the displacement members 164.

Since the transversely shifting mechanism 140 is structurally simpler than if the roller pairs 130, 132 were associated with respective opening and closing mechanisms, the; transversely shifting mechanism 140 has increased durability, can be manufactured inexpensively, and allows an available space to be utilized effectively.

In this embodiment, the transversely shifting mechanism 140 is mainly constructed of the roller pairs 130, 132 arranged along the plate 138, the transverse shifters 188*a*, 188*b* disposed between the roller pairs 130, 132, and the motor 182 for displacing the transverse shifters 188*a*, 188*b*. Consequently, the transversely shifting mechanism 140 is relatively simple in structure.

Since the transversely shifting mechanism 140 is capable of transversely positioning a recording sheet 20 with respect to its transversely central area, the recording sheet 20 can accurately be transversely positioned downstream of the transversely shifting mechanism 140.

Because the rollers 130*a*, 130*b* are made of a material (POM, etc.) having a small coefficient of friction, frictional forces produced between the rollers 130*a*, 130*b* and the recording sheet 20 are reduced, allowing the recording sheet 20 to be positioned accurately.

As described above, the sheet feeding device according to the present invention has a nip mechanism which is relatively simple in structure, high in durability, can be manufactured at a reduced cost, and allows an available space to be utilized effectively.

Furthermore, the sheet feeding device according to the present invention has a transversely shifting mechanism which is relatively simple in structure, can reliably transversely shift a recording sheet, and can accurately position a recording sheet in the transverse direction.

Although a certain preferred embodiment of the present invention has been shown and described in detail, it should be understood that various changes and modifications may be made therein without departing from the scope of the appended claims.

What is claimed is:

1. A sheet feeding device comprising:

a first roller and a second roller for feeding a sheet; and a nip mechanism mounted on said first roller and said second roller;

said nip mechanism comprising:

a first nip roller paired with said first roller;

a second nip roller paired with said second roller;

a cam member, said first nip roller and said second nip roller being rotatably supported on said cam member;

bearing means mounted on said cam member;

an eccentric shaft rotatably supported by said bearing means;

a stopper for preventing said first nip roller from being spaced from said first roller beyond a predetermined distance;

said first nip roller and said second nip roller being movable successively toward or away from said first roller and said second roller, respectively, in response to rotation of said eccentric shaft.

2. A sheet feeding device according to claim 1, wherein said bearing means has an oblong hole defined in said cam member.

3. A sheet feeding device according to claim 2, wherein said oblong hole defined in said cam member is closer to said first nip roller than to said second nip roller.

4. A sheet feeding device according to claim 3, wherein said first roller and said first nip roller are disposed upstream of said second roller and said second nip roller with respect to a direction in which said sheet is fed.

5. A sheet feeding device according to claim 4, wherein a nip pressure applied to said second roller by said second nip roller is greater than a nip pressure applied to said first roller by said first nip roller.

6. A sheet feeding device according to claim 3, wherein a nip pressure applied to said second roller by said second nip roller is greater than a nip pressure applied to said first roller by said first nip roller.

7. A sheet feeding device comprising:

a transversely shifting mechanism for transversely positioning a sheet;

said transversely shifting mechanism comprising:

an inlet roller pair disposed at an inlet of the transversely shifting mechanism, said inlet roller pair being openable and closable;

an outlet roller pair disposed at an outlet of the transversely shifting mechanism, said outlet roller pair being openable and closable, and disposed in a position lower than said inlet roller pair;

a guide member defining a feed path for the sheet from said inlet roller pair to said outlet roller pair; and pressing means disposed between said inlet roller pair and said outlet roller pair, for pressing said sheet from opposite side edges thereof to a center thereof.

8. A sheet feeding device according to claim 7, wherein said pressing means comprises:

a pair of pressers for pressing said sheet;

racks disposed respectively on said pressers;

a pinion held in mesh with said racks; and an actuator for rotating said pinion.

9. A sheet feeding device according to claim 8, wherein each of said pressers has a pressing surface for pressing said sheet, said pressing surface being recessed in a triangular cross section.

10. A sheet feeding device comprising:

a transversely shifting mechanism for transversely positioning a sheet;

said transversely shifting mechanism comprising:

an inlet roller disposed at an inlet of the transversely shifting mechanism;

an outlet roller disposed at an outlet of the transversely shifting mechanism, said outlet roller being disposed in a position lower than said inlet roller;

a guide member defining a feed path for the sheet from said inlet roller to said outlet roller; and pressing means disposed between said inlet roller and said outlet roller, for pressing said sheet from opposite side edges thereof to a center thereof; and a nip mechanism for nipping the sheet which is fed from said inlet roller and said outlet roller;

said nip mechanism comprising:

an inlet nip roller paired with said inlet roller;

an outlet nip roller paired with said outlet roller;

a cam member, said inlet nip roller and said outlet nip roller being rotatably supported on said cam member;

bearing means mounted on said cam member;

an eccentric shaft rotatably supported by said bearing means;

a stopper for preventing said inlet nip roller from being spaced from said inlet roller beyond a predetermined distance;

said inlet nip roller and said outlet nip roller being movable successively toward or away from said inlet roller and said outlet roller, respectively, in response to rotation of said eccentric shaft.

11. A sheet feeding device according to claim 10, wherein said bearing means has an oblong hole defined in said cam member.

12. A sheet feeding device according to claim 11, wherein said oblong hole defined in said cam member is closer to said inlet nip roller than to said outlet nip roller.

13. A sheet feeding device according to claim 12, wherein a nip pressure applied to said outlet roller by said outlet nip roller is greater than a nip pressure applied to said inlet roller by said inlet nip roller.

14. A sheet feeding device according to claim 11, wherein a nip pressure applied to said outlet roller by said outlet nip roller is greater than a nip pressure applied to said inlet roller by said inlet nip roller.

15. A sheet feeding device according to claim 10, wherein a nip pressure applied to said outlet roller by said outlet nip roller is greater than a nip pressure applied to said inlet roller by said inlet nip roller.

16. A sheet feeding device according to claim 10, wherein said pressing means comprises:

a pair of pressers for pressing said sheet;

racks disposed respectively on said pressers;

a pinion held in mesh with said racks; and an actuator for rotating said pinion.

17. A sheet feeding device comprising:

a transversely shifting mechanism for transversely positioning a sheet;

said transversely shifting mechanism comprising:

an inlet roller pair disposed at an inlet of the transversely shifting mechanism, said inlet roller pair being openable and closable;

an outlet roller pair disposed at an outlet of the transversely shifting mechanism, said outlet roller pair being openable and closable, and disposed in a position lower than said inlet roller pair;

a guide member defining a feed path for the sheet from said inlet roller pair to said outlet roller pair; and pressing means disposed between said inlet roller pair and said outlet roller pair, for pressing said sheet from opposite side edges thereof to a center thereof, wherein said inlet roller pair includes a fixed roller, said outlet roller pair includes a lower roller, and at least one of said fixed roller and said lower roller has a coefficient of friction smaller than rubber.

18. A sheet feeding device according to claim 17, wherein said pressing means comprises:

a pair of pressers for pressing said sheet;

racks disposed respectively on said pressers;

a pinion held in mesh with said racks; and an actuator for rotating said pinion.

19. A sheet feeding device comprising:

a transversely shifting mechanism for transversely positioning a sheet;

said transversely shifting mechanism comprising:

an inlet roller pair disposed at an inlet of the transversely shifting mechanism, said inlet roller pair being openable and closable;

an outlet roller pair disposed at an outlet of the transversely shifting mechanism, said outlet roller pair being openable and closable, and disposed in a position lower than said inlet roller pair;

a guide member defining a feed path for the sheet from said inlet roller pair to said outlet roller pair; and pressing means disposed between said inlet roller pair and said outlet roller pair, for pressing said sheet from opposite side edges thereof to a center thereof, wherein said inlet roller pair includes a fixed roller, said outer roller pair includes a lower roller, and at least one of said fixed roller and said lower roller is made of polyacetal.

20. A sheet feeding device according to claim 19, wherein said pressing means comprises:

a pair of pressers for pressing said sheet;

racks disposed respectively on said pressers;

a pinion held in mesh with said racks; and an actuator for rotating said pinion.

* * * * *